US010954902B2

(12) United States Patent
Mizuta et al.

(10) Patent No.: US 10,954,902 B2
(45) Date of Patent: Mar. 23, 2021

(54) INTERNAL COMBUSTION ENGINE

(71) Applicant: TOYOTA JIDOSHA KABUSHIKI KAISHA, Toyota (JP)

(72) Inventors: Yoshitomo Mizuta, Toyota (JP); Masaya Tagawa, Toyota (JP); Kenta Takatani, Nisshin (JP); Keisuke Hayakawa, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/667,514

(22) Filed: Oct. 29, 2019

(65) Prior Publication Data

US 2020/0149500 A1 May 14, 2020

(30) Foreign Application Priority Data

Nov. 13, 2018 (JP) ..... JP2018-212678

(51) Int. Cl.
*F02M 35/00* (2006.01)
*F02M 35/10* (2006.01)
(Continued)

(52) U.S. Cl.
CPC .. *F02M 35/10295* (2013.01); *F02M 25/0836* (2013.01); *F02M 25/0872* (2013.01); *F02M 35/104* (2013.01); *F02M 35/10209* (2013.01)

(58) Field of Classification Search
CPC .. F02D 41/009; F02D 45/00; F02D 2200/101; F02D 2041/281; G01D 3/32; G01D 5/00; F02M 35/10295; F02M 35/10209; F02M 35/104; F02M 35/12; F02M 35/10242; F02M 25/0836; F02M 25/0872; F02B 27/00; F02B 77/08
See application file for complete search history.

(56) References Cited

U.S. PATENT DOCUMENTS 2,023,936 A * 12/1935 Rolfe ..... F01L 1/00 123/336
4,105,004 A * 8/1978 Asai ..... F02M 27/08 123/470

(Continued)

FOREIGN PATENT DOCUMENTS

JP 2000-220537 A 8/2000
JP 2008-008164 A 1/2008

(Continued)

*Primary Examiner* — Phutthiwat Wongwian
*Assistant Examiner* — Sherman D Manley
(74) *Attorney, Agent, or Firm* — Oliff PLC

(57) ABSTRACT

An internal combustion engine includes a cylinder block including a cylinder, a cylinder head including an intake port, the intake port communicating with the cylinder, an intake manifold fixed to the cylinder head, the intake manifold being configured to supply intake air into the cylinder, and a dynamic vibration absorber configured to suppress vibration of the intake manifold. A direction that is orthogonal to both a central axis of the cylinder and a rotational axis of a crankshaft of the internal combustion engine is defined as a width direction. The dynamic vibration absorber is attached to the intake manifold on an opposite side of a center of gravity of the intake manifold from the cylinder head in the width direction.

3 Claims, 2 Drawing Sheets

(51) Int. Cl.
*F02M 25/08* (2006.01)
*F02M 35/104* (2006.01)

(56) References Cited

U.S. PATENT DOCUMENTS

| | | | | | |
|---|---|---|---|---|---|
| 4,372,120 | A * | 2/1983 | Ford, Jr. | F02B 75/22 | 123/184.31 |
| 4,901,681 | A * | 2/1990 | Pozniak | F02B 75/22 | 123/184.31 |
| 5,012,770 | A * | 5/1991 | Okamoto | F02M 35/10032 | 123/184.42 |
| 5,261,231 | A * | 11/1993 | Huh | F02B 21/00 | 60/312 |
| 5,437,344 | A * | 8/1995 | Wada | B60K 5/1216 | 123/192.1 |
| 5,477,819 | A * | 12/1995 | Kopec | F02M 35/112 | 123/184.42 |
| 2001/0047802 | A1* | 12/2001 | Itoh | F02M 35/112 | 123/585 |
| 2003/0127064 | A1 | 7/2003 | Nohara et al. | | |
| 2004/0107933 | A1* | 6/2004 | Lee | F02M 35/10301 | 123/184.21 |
| 2014/0345709 | A1* | 11/2014 | Jefford | F02M 25/0836 | 137/343 |
| 2016/0061166 | A1* | 3/2016 | Tanaka | F02M 35/10222 | 123/184.22 |
| 2020/0018264 | A1 | 1/2020 | Hirata et al. | | |

FOREIGN PATENT DOCUMENTS

| | | | |
|---|---|---|---|
| JP | 2011-226289 | A | 11/2011 |
| WO | 2018/173537 | A1 | 9/2018 |

* cited by examiner

INTERNAL COMBUSTION ENGINE

1. FIELD

The present invention relates to an internal combustion engine.

2. DESCRIPTION OF RELATED ART

Japanese Laid-Open Patent Publication No. 2008-008164 discloses an internal combustion engine including an intake manifold through which intake air from the outside flows. The downstream portion of the intake manifold is branched into multiple pipes. Each branched pipe is connected to the intake port of a corresponding cylinder. The upstream portion of the intake manifold is configured as a surge tank that reduces intake pulsation. The surge tank includes an acoustic control induction system (ACIS), which makes the length of an intake pipe variable. Further, an actuator that drives the acoustic control induction system is attached to the intake manifold by an elastically deformable attachment member. The rigidity (spring constant) of the attachment member is designed such that the attachment member serves as a spring and the actuator serves as a dynamic vibration absorber that acts as a mass for vibration of the intake manifold.

The above-described intake manifold causes the actuator and the attachment member of the acoustic control induction system to serve as dynamic vibration absorbers. However, there is a limit to changing the mass of the actuator and the rigidity of the attachment member while maintaining proper functions of the acoustic control induction system as the actuator and the attachment member. Thus, the vibration suppression characteristics of the dynamic vibration absorber are not necessarily optimized to vibration of the intake manifold. Accordingly, the vibration of the intake manifold may not be able to be sufficiently suppressed.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an internal combustion engine includes a cylinder block including a cylinder, a cylinder head including an intake port, the intake port communicating with the cylinder, an intake manifold fixed to the cylinder head, the intake manifold being configured to supply intake air into the cylinder, and a dynamic vibration absorber configured to suppress vibration of the intake manifold. A direction that is orthogonal to both a central axis of the cylinder and a rotational axis of a crankshaft of the internal combustion engine is defined as a width direction. The dynamic vibration absorber is attached to the intake manifold on an opposite side of a center of gravity of the intake manifold from the cylinder head in the width direction.

When the internal combustion engine vibrates in the direction extending along the central axis of the cylinder, the intake manifold vibrates in the direction extending along the central axis of the cylinder from the part fixed to the cylinder head. The amplitude of such vibration of the intake manifold in the direction extending along the central axis of the cylinder increases from the fixed part toward a distant part in the width direction of the internal combustion engine. In the above-described structure, the dynamic vibration absorber is attached at a position where the amplitude intake manifold is relatively large. Thus, even if vibration suppression characteristics of the dynamic vibration absorber are not optimized for vibration of the intake manifold, the vibration of the intake manifold can be easily suppressed.

In the above-described internal combustion engine, the intake manifold may include a manifold body that includes a passage through which intake air supplied into the cylinder flows and an attachment portion to which the dynamic vibration absorber is attached. The attachment portion may protrude from an outer surface of the manifold body toward the opposite side from the cylinder head in the width direction. The dynamic vibration absorber may be attached to a distal end of the attachment portion.

In the above-described structure, since the attachment portion protrudes from the outer surface of the manifold body, the amplitude is large at the distal end of the attachment portion. The dynamic vibration absorber is attached at the part where the amplitude is large. This effectively suppresses the vibration of the intake manifold.

The above-described internal combustion engine may include a canister configured to trap fuel vapor generated in a fuel tank, a purge hose configured to introduce the fuel vapor trapped by the canister into the intake manifold, and a purge valve configured to adjust a flow rate of the fuel vapor flowing through the purge hose. The purge valve may be fixed to the intake manifold by a purge valve stay. The purge valve may serve as a mass of the dynamic vibration absorber. The purge valve stay may serve as a spring of the dynamic vibration absorber.

In the above-described structure, the purge valve and the purge valve stay also serve as the dynamic vibration absorber. Thus, the vibration of the intake manifold can be suppressed without additionally arranging a dynamic vibration absorber having a single function.

In the above-described internal combustion engine, the purge valve stay may include an extension that extends from a first side toward a second side in the width direction, the extension being located between a portion of the purge valve stay fixed to the intake manifold and a portion of the purge valve stay fixed to the purge valve.

In the above-described structure, when the intake manifold vibrates in the direction extending along the central axis of the cylinder, the extension of the purge valve stay easily flexes in accordance with the vibration of the intake manifold. That is, the extension of the purge valve stay easily serves as a spring of the dynamic vibration absorber.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

An internal combustion engine E according to an embodiment will now be described with reference to the drawings. First, the schematic configuration of the internal combustion engine E will be described.

Figure 1:
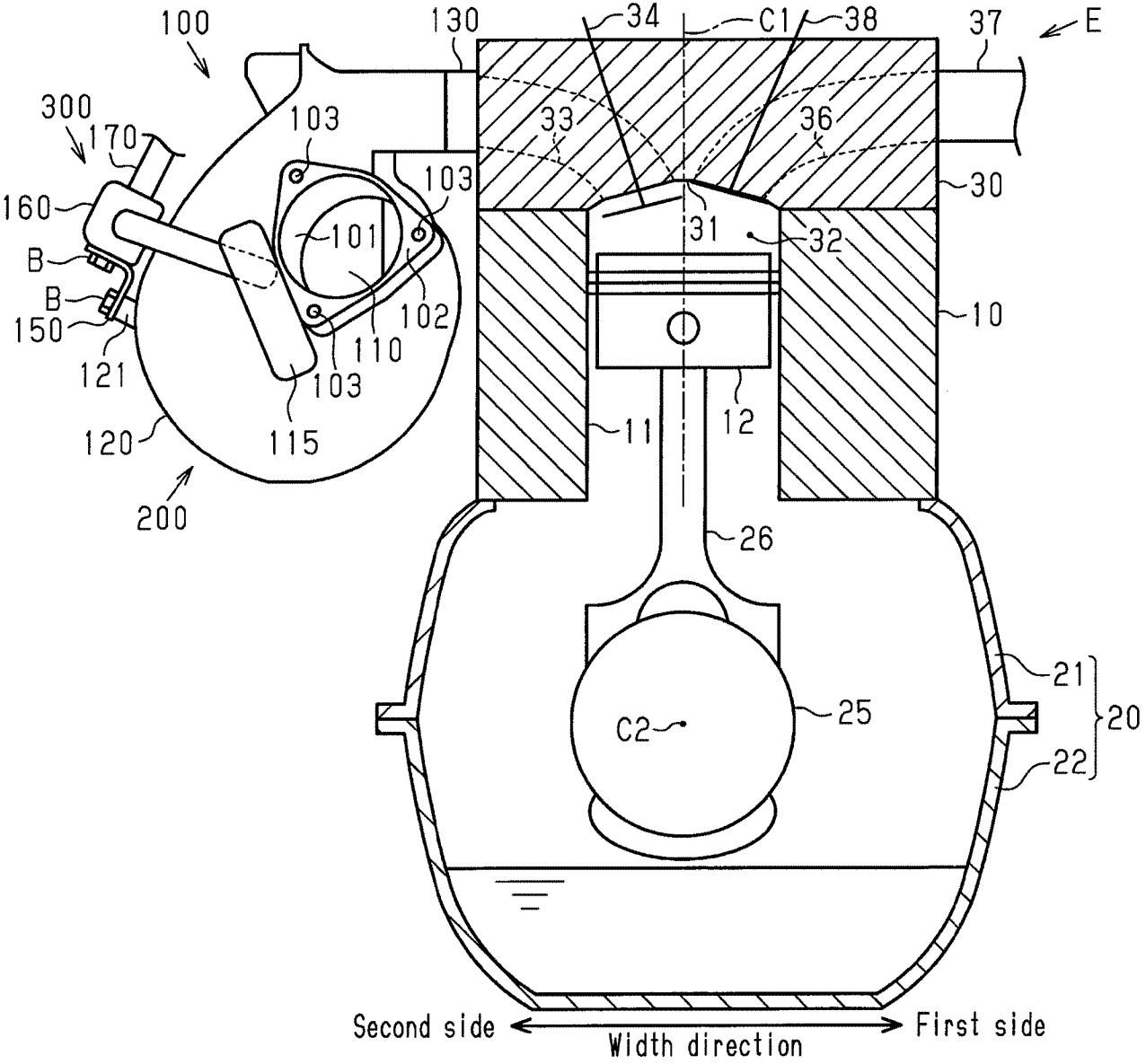
FIG. 1 is a side view of an internal combustion engine.

As shown in FIG. 1, the internal combustion engine E includes a cylinder block 10, the entirety of which is a rectangular parallelepiped. The cylinder block 10 includes multiple (for example, three) tubular cylinders 11. The cylinders 11 are laid out in a direction extending along a rotational axis C2 of a crankshaft 25 of the internal combustion engine E, that is, a thickness direction on the sheet of FIG. 1. In FIG. 1, part of the internal combustion engine E is illustrated in a cross-sectional view.

In the cylinder block 10, each cylinder 11 accommodates a piston 12 such that the piston 12 can move back and forth in the cylinder 11. The pistons 12 are coupled to the crankshaft 25 by a connecting rod 26.

A crankcase 21 is fixed to the lower surface of the cylinder block 10. The crankcase 21 has the form of a substantially rectangular tube along the outer edge of the cylinder block 10. A reservoir case 22 is fixed to the lower end surface of the crankcase 21. The reservoir case 22 includes an opening in its upper part and has the form of a rectangular box. The crankcase 21 and the reservoir case 22 configure an oil pan 20, which stores oil.

A cylinder head 30, the entirety of which has a rectangular parallelepiped shape, is fixed to the upper surface of the cylinder block 10. A recess 31 is recessed upward from the lower surface of the cylinder head 30. The recess 31 is circular as viewed in the direction extending along a central axis C1 of the cylinder 11. The diameter of the recess 31 is substantially the same as the diameter of the cylinder 11. The recess 31 is opposed to the cylinder 11. The inner wall of the recess 31, the inner wall of the cylinder 11, and the upper surface of the piston 12 define a combustion chamber 32.

The cylinder head 30 includes an exhaust port 36, through which exhaust gas is discharged from the cylinder 11. The direction that is orthogonal to both the central axis C1 of the cylinder 11 and the rotational axis C2 of the crankshaft 25, that is, the sideward direction in FIG. 1, is defined as a width direction. The exhaust port 36 is located on one side (i.e., first side) of the cylinder head 30 in the width direction. One end (i.e., first end) of the exhaust port 36 opens in the recess 31. The other end (i.e., second end) of the exhaust port 36 opens in the surface of the first side of the cylinder head 30 in the width direction. An exhaust passage 37 (exhaust manifold) is connected to the second end of the exhaust port 36.

Further, an exhaust valve 38 is attached to the cylinder head 30. The exhaust valve 38 selectively opens and closes the opening of the recess 31 in the exhaust port 36. The exhaust valve 38 is selectively opened and closed in cooperation with rotation of the crankshaft 25 by a valve actuation mechanism (not shown).

The cylinder head 30 includes an intake port 33, through which intake air is supplied into the cylinder 11. The intake port 33 is located on the other side (i.e., second side) of the cylinder head 30 in the width direction. One end (i.e., first end) of the intake port 33 opens in the recess 31. The other end (i.e., second end) of the intake port 33 opens in the surface of the second side of the cylinder head 30 in the width direction. An intake manifold 100, which is part of the intake passage, is connected to the second end of the intake port 33.

Additionally, an intake valve 34 is attached to the cylinder head 30. The intake valve 34 selectively opens and closes the opening of the recess 31 in the intake port 33. The intake valve 34 is selectively opened and closed in cooperation with rotation of the crankshaft 25 by the valve actuation mechanism (not shown).

Next, the intake manifold 100, which is connected to the cylinder head 30, will be described.

Figure 2:
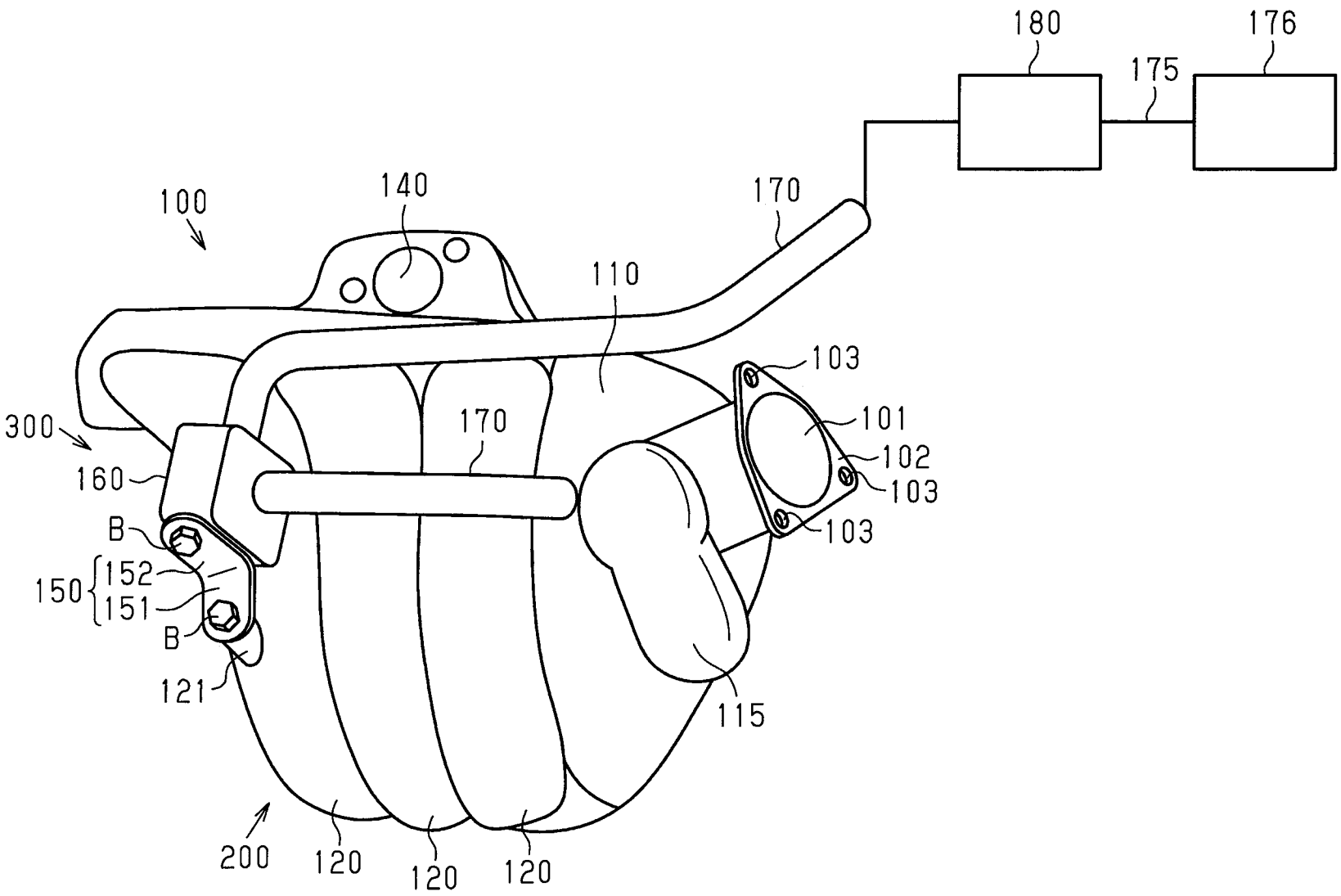
FIG. 2 is a perspective view of the intake manifold.

As shown in FIG. 2, the intake manifold 100 includes an intake part 101, through which intake air is drawn in from the outside of the vehicle. As shown in FIG. 1, the intake part 101 has a substantially tubular shape extending in the direction that is generally along the rotational axis C2 of the crankshaft 25.

Referring to FIG. 2, the intake part 101 has a first end, which is located on the upstream side with respect to the flow of intake air. A flange 102 extends from the outer circumferential surface of the first end of the intake part 101. Bolt holes 103 extend through the flange 102. Inserting bolts through the bolt holes 103 fixes a tubular throttle body (not shown) to the intake manifold 100. The throttle body includes a throttle valve used to adjust an intake amount. That is, intake air from the outside of the vehicle flows through the throttle body and then flows through the intake part 101 into the intake manifold 100.

The intake part 101 has a second end, which is located on the downstream side with respect to the flow of intake air. A surge tank 110, which reduces intake pulsation, is connected to the second end of the intake part 101. The surge tank 110 has the form of a substantially rectangular parallelepiped box that is generally long in the axial direction of the intake part 101. In this manner, the intake manifold 100 of the present embodiment is integrated with the surge tank 110.

Although not shown in the drawings, the surge tank 110 includes an acoustic control induction system (ACIS), which makes the length of an intake pipe variable. The acoustic control induction system is driven by an ACIS actuator 115. As shown in FIG. 2, the ACIS actuator 115 is attached to the outer surface of the intake manifold 100 adjacent to the intake part 101.

Three branch passages 120 are connected to the surge tank 110. The branch passages 120 are laid out in the direction extending along the axis of the intake part 101. As shown in FIG. 1, each branch passage 120 extends around the surge tank 110. More specifically, each branch passage 120 is curved to extend along the surface of the surge tank 110 on the first side in the width direction, the lower side of the surge tank 110, the surface of the surge tank 110 on the second side in the width direction, and the upper side of the surge tank 110.

A connection flange 130 is arranged on the end of each branch passage 120 located on the downstream side with respect to the flow of intake air, which is on the opposite side from the surge tank 110. The connection flange 130 couples the three branch passages 120 to one another. Each branch passage 120 opens in the end surface of the connection flange 130. The connection flange 130 is fixed to the second side of the cylinder head 30 in the width direction.

As shown in FIG. 2, the intake manifold 100 includes an EGR supply passage 140, which causes exhaust gas that has been burned in the internal combustion engine E to be recirculated and supplied to each branch passage 120. In this embodiment, the opening of the EGR supply passage 140 connecting to the outside is directed toward the opposite side from the opening of each branch passage 120. Although not shown in the drawings, the EGR supply passage 140 is branched into three passages in the intake manifold 100, each communicating with the inside of the corresponding branch passage 120.

In the present embodiment, the intake part 101, the surge tank 110, the branch passage 120, the connection flange 130, and the EGR supply passage 140 configure a manifold body 200.

One of the branch passages 120 of the manifold body 200 located farthest from the intake part 101 in the layout direction of the branch passages 120 has an outer surface on the second side in the width direction. A boss 121 protrudes from the outer surface of the branch passage 120. The boss 121 is substantially tubular. As shown in FIG. 1, the boss 121 extends further toward the second side than to the end of the branch passage 120 in the width direction. That is, the distal end surface of the boss 121 is located further toward the second side in the width direction than the extreme end of the second side of the branch passage 120 in the width direction. A purge valve 160 is attached to the boss 121 by a purge valve stay 150.

Subsequently, the purge valve 160 and the purge valve stay 150 will be described.

The internal combustion engine E includes a fuel injection valve (not shown) that injects fuel into the cylinder 11. As shown in FIG. 2, the vehicle provided with the internal combustion engine E includes a fuel tank 176, which stores fuel supplied to the fuel injection valve. One end (i.e., first end) of a vapor passage 175 is connected to the fuel tank 176. The internal combustion engine E includes a canister 180, which is connected to the other end (i.e., second end) of the vapor passage 175. The canister 180 adsorbs fuel vapor generated in the fuel tank 176.

One end (i.e., first end) of a purge hose 170 is connected to the canister 180. The other end (i.e., second end) of the purge hose 170 is connected to the surge tank 110 of the intake manifold 100. The purge valve 160 is attached to an intermediate part of the purge hose 170. The purge valve 160 adjusts the flow rate of fuel vapor flowing through the purge hose 170. In FIG. 1, part of the purge hose 170 is omitted to simplify the illustration.

The purge valve 160 is fixed to the boss 121 by the purge valve stay 150. That is, the boss 121 serves as an attachment portion of the purge valve stay 150.

The purge valve stay 150 is shaped by bending the middle part of a plate that is substantially rectangular in a plan view by approximately 90 degrees. That is, the purge valve stay 150 is shaped such that a plate-shaped distal end portion 152 extends at an angle of approximately 90 degrees from one end of a plate-shaped base 151. The other end of the base 151 of the purge valve stay 150 is fixed to the boss 121 by an attachment bolt B. Further, the purge valve stay 150 is attached to the boss 121 such that a boundary between the base 151 and the distal end portion 152 (i.e., bent part) is directed toward the intake manifold 100. That is, the part of the purge valve stay 150 between a portion of the purge valve stay 150 fixed to the boss 121 and a portion of the purge valve stay 150 fixed to the purge valve 160 serves as an extension that extends from the first side toward the second side in the width direction. The purge valve stay 150 is made of aluminum alloy.

The purge valve 160 is fixed to the distal end portion 152 of the purge valve stay 150 by an attachment bolt B. In this embodiment, when the intake manifold 100 vibrates, the purge valve 160 serves as a mass of a dynamic vibration absorber 300 and the purge valve stay 150 serves as a spring of the dynamic vibration absorber 300.

In the present embodiment, the center of gravity of the intake manifold 100 in the width direction is substantially the center of the intake manifold 100 in the width direction. The purge valve stay 150, which is part of the dynamic vibration absorber 300, is attached to the distal end surface of the boss 121, which is located at the extreme second end in the width direction. Thus, in the present embodiment, the purge valve stay 150 and the purge valve 160, which serve as the dynamic vibration absorbers 300, are attached to the intake manifold 100 at a position closer to the second side than to the center of gravity of the intake manifold 100 in the width direction.

The operation and advantages of the present embodiment will now be described.

(1) In the present embodiment, when the internal combustion engine E vibrates in the direction extending along the central axis C1 of the cylinder 11, the intake manifold 100 vibrates in the direction extending along the central axis C1 of the cylinder 11 from the part where the connection flange 130 is fixed to the cylinder head 30. The amplitude of such vibration of the intake manifold 100 in the direction extending along the central axis C1 of the cylinder 11 increases from the fixed part toward the second side in the width direction of the internal combustion engine E.

In the present embodiment, the boss 121 protrudes from the outer surface of the second side in the width direction of the branch passage 120, which is part of the manifold body 200. The boss 121 extends to the second side from the end of the branch passage 120 in the width direction. The dynamic vibration absorber 300 is attached to the distal end surface of the boss 121, which is located at the extreme second end in the width direction of the intake manifold 100. Thus, since the dynamic vibration absorber 300 of the present embodiment is attached to the intake manifold 100 on the extreme second side, the dynamic vibration absorber 300 is attached to intake manifold 100 at a position where the amplitude becomes the largest in the direction extending along the central axis C1 of the cylinder 11, which is generally in the vertical direction. This allows the dynamic vibration absorber 300 to effectively suppress vibration of the intake manifold 100.

(2) Recently, the regulation of exhaust gas has been reinforced. Thus vehicles need to be equipped with a fuel vapor treatment apparatus. The canister 180, the purge valve 160, and the purge hose 170 are essential components of the fuel vapor treatment apparatus. That is, the fuel vapor treatment apparatus including the purge valve 160 is in reality standard equipment for the vehicle including the internal combustion engine E. In the present embodiment, the purge valve 160 and the purge valve stay 150 also serve as the dynamic vibration absorber 300. Thus, in the present embodiment, vibration of the intake manifold 100 can be suppressed without additionally arranging a dedicated dynamic vibration absorber 300 having a single function.

(3) In the present embodiment, the extension of the purge valve stay 150 extends from the first side toward the second side in the width direction. Further, the purge valve stay 150 is made of aluminum alloy. Thus, the extension of the purge valve stay 150 is elastically deformed relatively easily. Accordingly, the extension of the purge valve stay 150 easily flexes in accordance with vibration of the intake manifold 100 in the direction extending along the central axis C1 of the cylinder 11. Thus, the extension of the purge valve stay 150 easily serves as a spring of the dynamic vibration absorber 300.

(4) In the present embodiment, in addition to the intake part 101, the ACIS actuator 115 is attached to the outer surface of the intake manifold 100 adjacent to the intake part 101. Further, the throttle body is attached to the flange 102. Furthermore, the second end of the purge hose 170 is connected to the surge tank 110 in the vicinity of the intake part 101 of the intake manifold 100. Thus, a large number of components are attached to the intake manifold 100 on the same side as the intake part 101 in the layout direction of the branch passages 120. In contrast, a smaller number of components are attached to the intake manifold 100 on the opposite side from the intake part 101 in the layout direction of the branch passages 120 than on the same side as the intake part 101. Accordingly, when the purge valve 160 and the purge valve stay 150 are attached to the boss 121 of the present embodiment, interference with peripheral components hardly occurs. This facilitates the attachment of the purge valve 160 and the purge valve stay 150 to the boss 121. When the purge valve 160 and the purge valve stay 150 serve as the dynamic vibration absorber 300, the purge valve 160 oscillates. However, even if the purge valve 160 oscillates in such a manner, interference with peripheral components hardly occurs.

The above-illustrated embodiment may be modified as follows. The present embodiment and the following modifications can be combined as long as the combined modifications remain technically consistent with each other.

The dynamic vibration absorber 300 does not have to be attached to the intake manifold 100 on the extreme second side in the width direction. The attachment position of the dynamic vibration absorber 300 simply needs to be located closer to the second side than to the center of gravity of the intake manifold 100 in the width direction of the intake manifold 100. When the attachment position of the dynamic vibration absorber 300 is set in such a manner, the dynamic vibration absorber 300 can be attached to a position where the amplitude is relatively large. This suppresses vibration of the intake manifold 100 in a favorable manner.

The distal end surface of the boss 121 does not have to be located closer to the second side in the width direction than to the extreme second end in the width direction of the branch passages 120. Even in this case, at least the position of the dynamic vibration absorber 300 attached to the distal end surface of the boss 121 simply needs to be located closer to the second side than to the center of gravity of the intake manifold 100 in the width direction of the intake manifold 100. As long as the boss 121 protrudes from the outer surface of the branch passage 120 toward the second side in the width direction, the attachment position of the dynamic vibration absorber 300 can be simply set to the second side in the width direction.

The boss 121 does not have to protrude from the branch passage 120. For example, the boss 121 may protrude from the intake part 101 of the manifold body 200.

The attachment portion for attaching the dynamic vibration absorber 300 is not limited to the boss 121. For example, a plate-shaped flange may extend from the branch passage 120.

The dynamic vibration absorber 300 does not have to be attached to the distal end surface of the boss 121. For example, instead of arranging the boss 121 protruding from the manifold body 200, the purge valve stay 150 may be directly attached to the manifold body 200

The dynamic vibration absorber 300 is not limited to the structure of the purge valve 160 and the purge valve stay 150 of the present embodiment. For example, a dynamic vibration absorber 300 having a single function may be additionally attached. Alternatively, the ACIS actuator 115 may serve as a mass of the dynamic vibration absorber 300.

The number of the cylinders 11 is not limited to three like in the present embodiment. Instead, the number of the cylinders 11 may be less than or equal to two or greater than or equal to four.

The cylinders 11 do not have to be laid out in series. For example, when the internal combustion engine E is of a V-type, cylinders 11 simply need to be laid out in two rows such that two intake manifolds 100 and such that two dynamic vibration absorbers 300 are respectively attached to the intake manifolds 100.

The shape of the intake manifold 100 may be changed in correspondence with the structure of the internal combustion engine E.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. An internal combustion engine comprising:

a cylinder block including a cylinder;

a cylinder head including an intake port, the intake port communicating with the cylinder;

an intake manifold fixed to the cylinder head, the intake manifold being configured to supply intake air into the cylinder;

a canister configured to trap fuel vapor generated in a fuel tank;

a purge hose configured to introduce the fuel vapor trapped by the canister into the intake manifold; and a dynamic vibration absorber configured to suppress vibration of the intake manifold, wherein a direction that is orthogonal to both a central axis of the cylinder and a rotational axis of a crankshaft of the internal combustion engine is defined as a width direction, the dynamic vibration absorber is attached to the intake manifold on an opposite side of a center of gravity of the intake manifold from the cylinder head in the width direction, and the dynamic vibration absorber includes:

a purge valve configured to adjust a flow rate of the fuel vapor flowing through the purge house, the purge valve serving as a mass of the dynamic vibration absorber, and a purge valve stay configured to fix the purge valve to the intake manifold, the purge valve stay serving as a spring of the dynamic vibration absorber and allowing the purge valve to oscillate when the intake manifold vibrates in a direction extending along the central axis of the cylinder.

2. The internal combustion engine according to claim 1, wherein the intake manifold includes a manifold body that includes a passage through which intake air supplied into the cylinder flows, and an attachment portion to which the dynamic vibration absorber is attached, the attachment portion protrudes from an outer surface of the manifold body toward the opposite side from the cylinder head in the width direction, and the dynamic vibration absorber is attached to a distal end of the attachment portion.

3. The internal combustion engine according to claim 1, wherein the purge valve stay includes an extension that extends from a first side toward a second side in the width direction, the extension being located between a portion of the purge valve stay fixed to the intake manifold and a portion of the purge valve stay fixed to the purge valve.

* * * * *